United States Patent [19]

Bonazoli et al.

[11] Patent Number: 4,528,479

[45] Date of Patent: Jul. 9, 1985

[54] CIRCUIT BREAKER BY-PASS ELEMENT

[75] Inventors: Robert P. Bonazoli, Hamilton, Mass.; John W. Shaffer, Williamsport, Pa.

[73] Assignee: GTE Products Corporation, Stamford, Conn.

[21] Appl. No.: 520,865

[22] Filed: Aug. 5, 1983

[51] Int. Cl.[3] ..... H01J 7/44; H05B 41/06

[52] U.S. Cl. ..... 315/73; 315/104; 315/106; 337/24; 337/25; 337/27; 337/110; 337/159

[58] Field of Search ..... 315/72, 73, 74, 104, 315/106; 313/316; 337/24, 25, 27, 221, 401

[56] References Cited

U.S. PATENT DOCUMENTS

| | | | |
|---|---|---|---|
| 4,013,919 | 3/1977 | Corbley | 315/73 |
| 4,097,779 | 6/1978 | Latassa | 315/73 |
| 4,171,519 | 10/1979 | Cassidy et al. | 337/25 |
| 4,355,261 | 10/1982 | Cohen et al. | 315/73 |
| 4,388,557 | 6/1983 | Shaffer | 315/73 |
| 4,412,152 | 10/1983 | Barakitis et al. | 315/73 |
| 4,415,836 | 11/1983 | Decuester et al. | 315/73 |
| 4,419,607 | 12/1983 | Barakitis et al. | 315/73 |
| 4,465,954 | 8/1984 | Barakitis | 315/73 |

*Primary Examiner*—Jerome Massie

*Attorney, Agent, or Firm*—Thomas H. Buffton

[57] ABSTRACT

A circuit breaker for a rapid-start fluorescent lamp includes a pair of electrical conductors sealed into a glass bottle, a bimetal switch within the bottle having one end affixed and the other end contacting the pair of electrical conductors and a meltable by-pass element shunting the pair of electrical conductors and formed of a material having a relatively high cold resistivity and a low temperature coefficient of resistance.

7 Claims, 2 Drawing Figures

CIRCUIT BREAKER BY-PASS ELEMENT

CROSS REFERENCE TO OTHER APPLICATIONS

The following concurrently-filed applications relate to rapid-start fluorescent lamps and bimetal circuit breakers for fluorescent lamps: Application Ser. Nos. 520,860; 520,863 and 520,862.

TECHNICAL FIELD

This invention relates to rapid-start fluorescent lamps and more particularly to a circuit breaker having a meltable by-pass element and suitable for use in a rapid-start fluorescent lamp.

BACKGROUND ART

Generally, the most commonly encountered fluorescent lamps are the so-called "preheat" and "rapid-start" types of fluorescent lamp. In the "preheat" type of lamp, heater current flows through the lamp electrode during lamp ignition. Thereafter, an external voltage sensitive starter opens the electrical circuit to the lamp electrode and heater current flow is discontinued. The "rapid-start" type of fluorescent lamp normally has a constant flow of heater current through each electrode not only during ignition but also during operation of the lamp. However, heater current flow during operation, as in the "rapid-start" lamp, is lost power which undesirably reduces the operational efficiency of the lamp.

Numerous suggestions have been made for enhancing the efficiency of "rapid-start" type fluorescent lamps. For example, U.S. Pat. Nos. 4,052,687; 4,097,779; 4,114,968; 4,156,831 and 4,171,519 which are all assigned to the Assignee of the present application, provide numerous configurations for enhanced operation of "rapid-start" type fluorescent lamps. Primarily, each provides a thermally responsive circuit breaker suitable for discontinuing heater current during operation of the fluorescent lamp.

However, it has been found that problems still exist in the fabrication of enhanced rapid-start fluorescent lamps in spite of the above-enumerated advantages of such improved configurations. For example, it is known that the electrode or filament for a rapid-start fluorescent lamp is provided with an emissive coating of alkaline earth oxides and that this electrode requires current passage therethrough in order to activate and outgas the coating. Also, the lamps wherein the electrode is located are relatively hot from the necessary hot sealing process. Moreover, this relatively hot temperature is sufficient to open the bimetal switch of the circuit breaker therein which, in turn, would ordinarily prevent the desired current flow for activating the electrode or filament coating. However, the addition of a meltable by-pass element permits this electrode coating activation even though the bimetal switch is open and upon completion of the electrode material activation is removed as by melting for instance.

Also, the above-mentioned circuit breaker within a rapid-start lamp represents but a small portion of the cost of the lamp but can easily render the whole lamp useless if defective. For example, a broken, missing or improperly attached meltable by-pass element will prevent activation of the electrode coating and result in catastrophic failure of the rapid-start lamp. Thus, it is a highly desirable condition that the circuit breaker can be tested prior to inclusion within the rapid-start lamp.

Previously, the meltable by-pass element in circuit breakers for rapid-start fluorescent lamps was fabricated from a very low cold resistance molybdenum wire. Such a wire was selected as a compromise material which would pass sufficient current to insure activation of the electrode coating and still consistently and reliably melt or burn open in response to an energy pulse provided by a discharging capacitor. However, this very low cold resistance of the meltable by-pass element (about 30 milliohms or less for 0.002-inch diameter molybdenum wire) makes automatic inspection and resistance measurement thereof a formidable problem.

OBJECTS AND SUMMARY OF THE INVENTION

Therefore, it is an object of the present invention to provide an enhanced circuit breaker suitable for use in a rapid-start fluorescent lamp. Another object of the invention is to enhance the capabilities of a rapid-start fluorescent lamp. Still another object of the invention is to increase the efficiency of a rapid-start fluorescent lamp. A further object of the invention is to provide a circuit breaker having materials and characteristics permitting automatic pre-testing for resistance values and operational capabilities.

These and other objects, advantages and capabilities are achieved in one aspect of the invention by a circuit breaker which includes a glass bottle having a pair of electrical conductors sealed therein and passing therethrough with a bimetal switch therein connected to one and contacting the other one of the pair of electrical conductors and a meltable by-pass element having a relatively high cold resistivity and a low temperature coefficient of resistance shunting the pair of electrical conductors within the glass bottle.

BEST MODE FOR CARRYING OUT THE INVENTION

For a better understanding of the present invention, together with other and further objects, advantages, and capabilities thereof, reference is made to the following disclosure and appended claims taken in conjunction with the above-described drawings.

Figure 1:
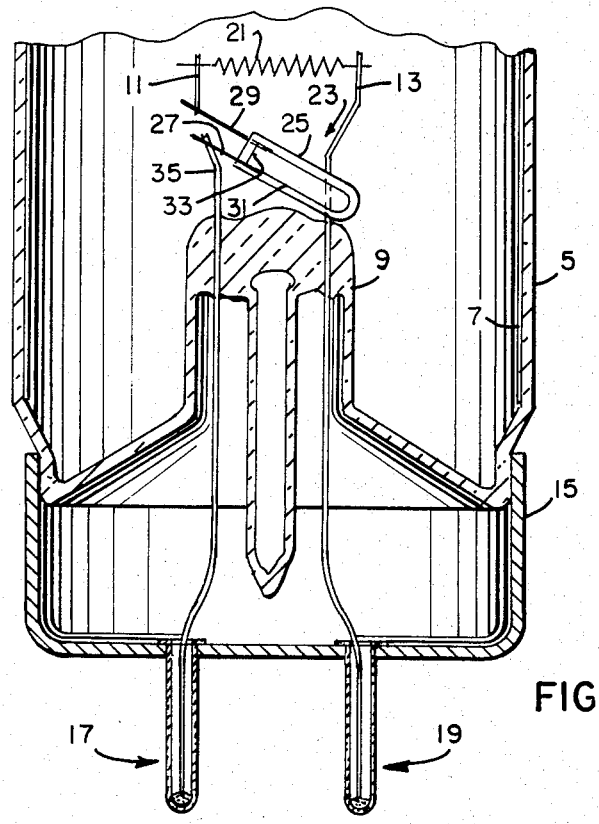
FIG. 1 is an elevational view, partly in section, of one end of a rapid-start fluorecent lamp having a circuit breaker of the invention therein.

Referring to FIG. 1 of the drawings, a rapid-start fluorescent lamp includes an elongated glass envelope 5 having a coating of phosphors 7 on the inner wall surface of the envelope 5. A glass stem member 9 is sealed into the end of the envelope 5 and includes a pair of electrical leads 11 and 13 sealed therein and passing therethrough. An end cap 15 is telescoped over and attached to the end of the glass envelope 5 and includes a pair of pins 17 and 19 electrically connected to a portion of the electrical leads 11 and 13 and formed to provide electrical connection in an external source (not shown). Moreover, the envelope 5 has a gas fill therein selected from the group consisting of argon, krypton, neon, helium and combinations thereof.

At least one electrode 21 is located within the envelope 5 and connected at opposite ends to the electrical leads 11 and 13. Thus, the longitudinal axis of the electrode 21 is in a direction substantially normal to the direction of the electrical leads 11 and 13. Moreover, this electrode 21, which is frequently referred to as a filament or cathode, is a well known type used in rapid start fluorescent lamps and usually includes a tungsten coil having a coating thereon in the form of alkaline earth oxides which were applied in the form of carbonates and processed to provide the oxides.

Figure 2:
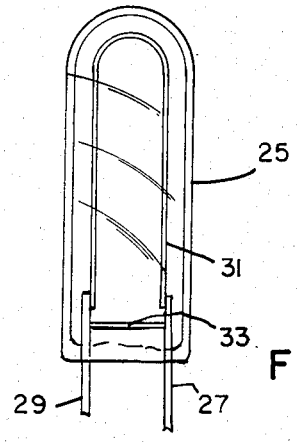
FIG. 2 is a cross-sectional view of the circuit breaker of FIG. 1.

Disposed within the envelope 5 is a circuit breaker 23 (FIG. 2). The circuit breaker 23 is preferably in the form of a glass bottle 25 having a press seal at one end thereof. A pair of electrical conductors 27 and 29 are sealed into and pass through the press seal of the glass bottle 25. Also, a thermally-sensitive bimetal 31 is positioned within the glass bottle 25 with one end thereof attached to one of the electrical conductors 27 and the opposite end of the bimetal 31 contacting the other electrical conductor 29. Further a conductive and meltable by-pass element 33, which is meltable in response to a short-duration high voltage pulse potential, shunts the bimetal 31 and is electrically connected to the electrical conductors 27 and 29. Moreover, the electrical conductors 27 and 29 extending outwardly of the glass bottle 25 are connected to the base pins 17 (FIG. 1) and to the electrical lead 11 respectively with the electrical lead 11 also connected to one end of the electrode 21.

Referring more specifically to the meltable by-pass element 33, it has been found that high resitivity alloy wires which preferably have a relatively low temperature coefficient of resistance can not only conduct the electrode current needed for activation of emissive coatings thereon without premature burn out of the by-pass element 33 but also, because of the relatively high resistance, facilitate the desired preuse automated testing necessary to insure operation. By way of example, it has been found that alloys such as nichrome (80% Ni: 20% chrome): constantam (60% copper: 40 nickel) and maganim (12% maganin 85% copper and 4.0% nickel) are especially suitable as materials for the by pass element 33 of rapid-start fluorescent lamps. Other suitable alloys are copper alloys containing nickel and/or manganese and nickel or iron alloys which contain chromium together with lesser percentages of such elements as manganese, silicon, aluminum or copper. Moreover, a preferred material for the by-pass element 33 is a material known as ⊱302 stainless steel having a diameter of about 0.003 to 0.003-inch, a resistance of about 470 ohms/circular mil ft. @ about 25° C., a temperature coefficient of resistance of about 630 microhoms per ohm per °C. as measured from about 0° to 100° C. and includes about 9% ni, 18% cr, 2% mn, 1;1 % si and the balance fe.

Since the diameter of any suitable alloy wire is a function of at least the resistivity, temperature coefficient of resistance and melting point, it has been found that the optimum alloy wire diameter is one that will reliably carry a current of about one ampere for at least one minute in an argon atmosphere of about one atmosphere pressure. Preferably, the alloy wire should have an electrical resistivity of at least 100 ohms per circular mil-foot at 20° C. and a temperature coefficient of resistance of not more than about 1000 microhms per ohm per °C. as measured from about 0° to 100° C.

Although not to be in any way construed as limiting, the following alloys are applicable for use in circuit breakers employed in rapid-start fluorescent lamps:

| PERCENTAGES | |
|---|---|
| 55 Cu - 45 Ni | |
| 87 Cu - 13 Mn | |
| 83 Cu - 13 Mn - 4 Ni | |
| 70 Cu - 10 Mn - 20 Ni | |
| 67 Cu - 25 Mn - 5 Ni | |
| 75 Ni - 20 Cr - 3 Al - 2 Cu | |
| 76 Ni - 4 Cr - 3 Mn | |
| 60 Ni - 16 Cr - 24 Fe | |
| 35 Ni - 20 Cr - 45 Fr | |
| 72 Fe - 23 Cr - 5 Al - 0.5 Co | |
| 9 Ni - 18 Cr - 2 Mn - 1.0 Si | Bal. Fe |

While there have been shown what are at present considered to be preferred embodiments of the invention, it will be apparent to those skilled in the art that various changes and modifications can be made herein without departing from the scope of the invention as defined by the appended claims.

What is claimed is:

1. A circuit breaker for a rapid-start fluorescent lamp comprising a sealed glass bottle, a bimetal switch means normally closed at room temperature and open at a predetermined temperature higher than room temperature, a pair of electrical conductors sealed into and passing through said glass bottle and a meltable by-pass element short-circuiting said bimetal switch means, said meltable by-pass element having an electrical resistivity of not less than about 100 ohms/circular mil foot at 20° C. and a temperature coefficient of resistance of not more than about 1000 microhms per ohm per °C. in the range of about 0° to 100° C.

2. The circuit breaker of claim 1 wherein said meltable by-pass element is an alloy selected from the group consisting of copper containing nickel and/or manganese and nickel or iron containing chromium and a metal selected from the group consisting of manganese.

3. The circuit breaker of claim 1 wherein said meltable by-pass element is an alloy wire of a diameter and resistivity sufficient to carry a current of about one ampere for at least one minute in an argon atmosphere of about one atmosphere.

4. The circuit breaker of claim 1 wherein said meltable by-pass element is a wire alloy of the type having about 80% nickel and 20% chrome.

5. The circuit breaker of claim 1 wherein said meltable by-pass element is a wire alloy which includes about 60% copper and 40% nickel.

6. The circuit breaker of claim 1 wherein said meltable by-pass element is a wire alloy consiting essentially of 12% manganese, 84% copper and 4% nickel therein.

7. The circuit breaker of claim 1 wherein said meltable by-pass element is a stainless steel alloy consisting essentially of 9% nickel, 18% chromium, 2% manganese, 1% silicon and the balance iron.

* * * * *